United States Patent [19]

Hawkes et al.

[11] 4,062,674

[45] Dec. 13, 1977

[54] IRON OR STEELMAKING PROCESS

[75] Inventors: David A. Hawkes, Guisborough; Andray Uemlianin, Redcar; Hope Lubanska, Acton, all of England

[73] Assignee: British Steel Corporation, London, England

[21] Appl. No.: 740,860

[22] Filed: Nov. 11, 1976

[30] Foreign Application Priority Data

Nov. 21, 1975 United Kingdom ..... 48006/75

[51] Int. Cl.[2] ..... C21C 7/00

[52] U.S. Cl. ..... 75/61; 75/93 R

[58] Field of Search ..... 75/61, 93

[56] References Cited

U.S. PATENT DOCUMENTS 3,814,596 6/1974 Voice ..... 75/93

*Primary Examiner*—Peter D. Rosenberg

*Attorney, Agent, or Firm*—Bacon & Thomas

[57] ABSTRACT

An iron or steelmaking process is described wherein iron or steelmaking materials are injected into one end of a generally horizontal rotary furnace rotatable at such a speed that the furnace contents are maintained around the interior by centrifugal force in an outer liquid metal layer and an inner slag layer spread on the liquid metal. The process comprises intermittently reducing the speed of rotation of the furnace to reduce the centrifugal force and permit liquid metal to be discharged from that end of the furnace remote from the input end in preference to the slag. Various means are described for accentuating the preferential discharge of liquid metal.

7 Claims, 16 Drawing Figures

IRON OR STEELMAKING PROCESS

Figure 1:
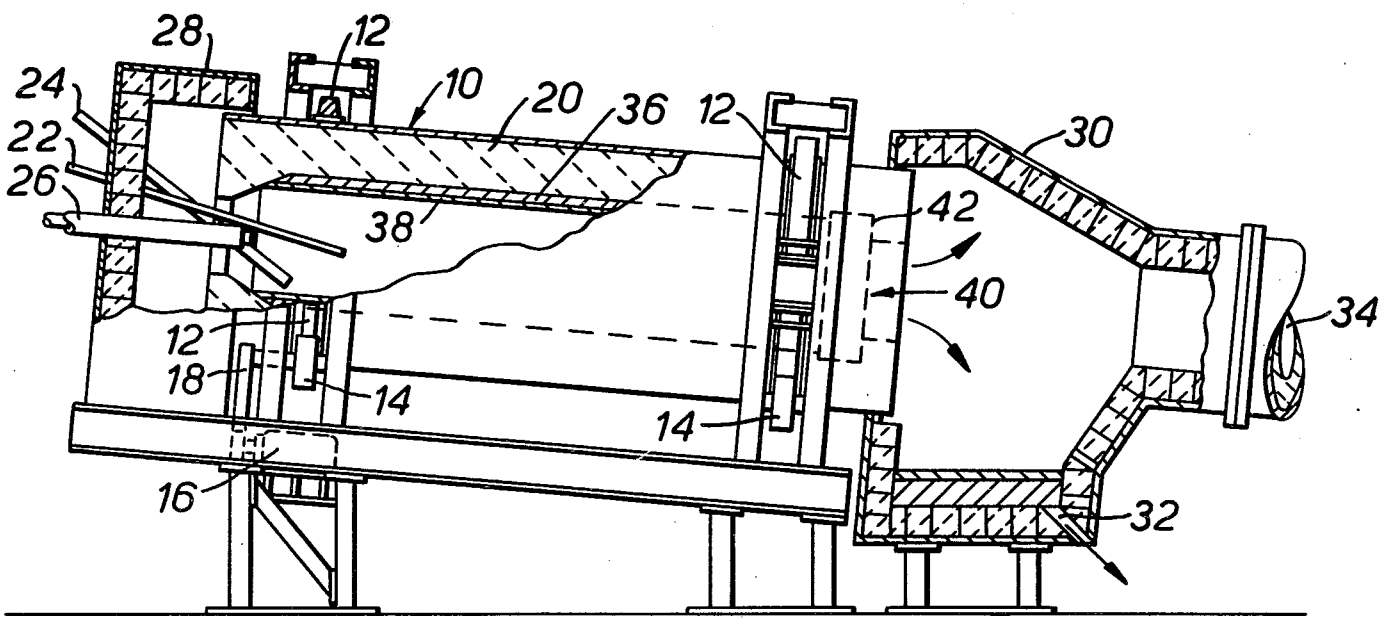
Figure 2A:
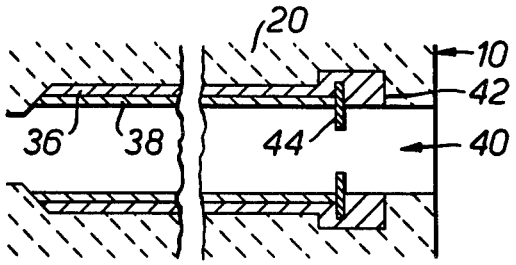
Figure 2B:
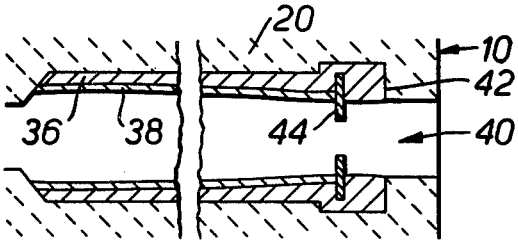
Figure 2C:
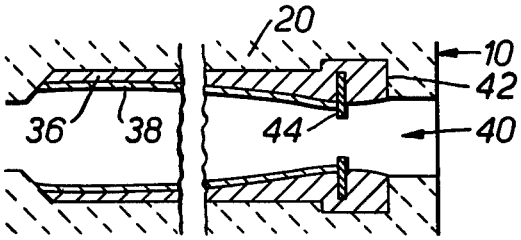
Figure 2D:
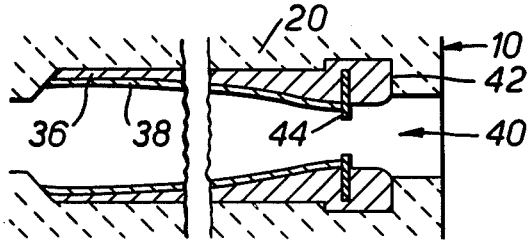
Figure 2E:
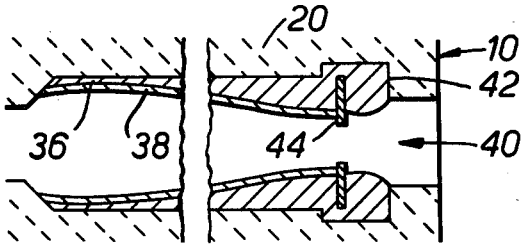
Figure 3A:
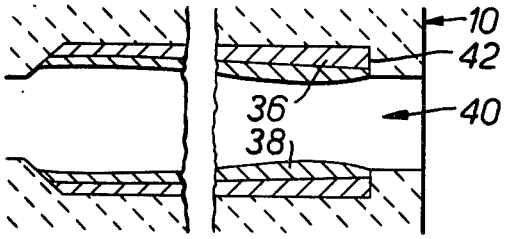
Figure 3B:
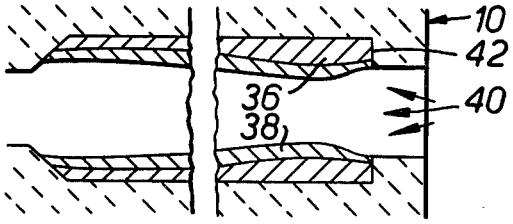
Figure 3C:
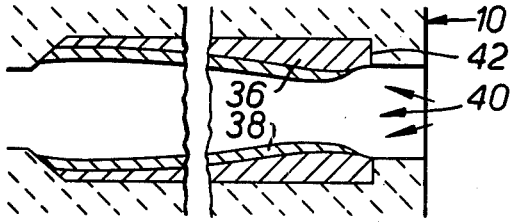
Figure 3D:
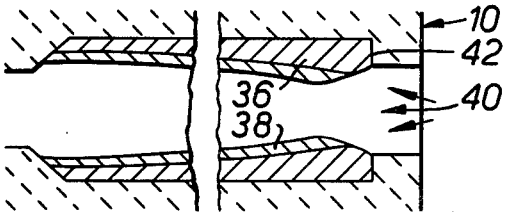
Figure 3E:
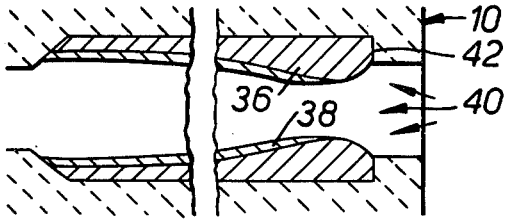
Figure 4A:
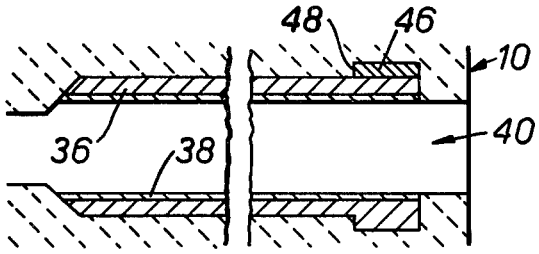
Figure 4B:
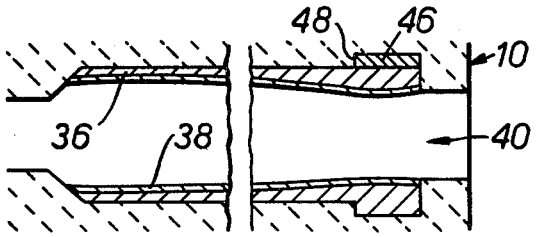
Figure 4C:
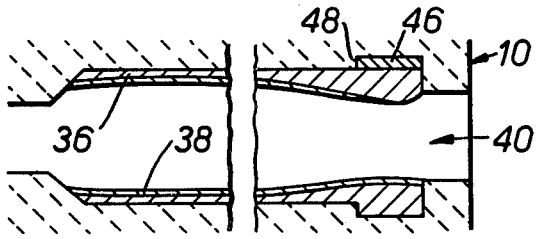
Figure 4D:
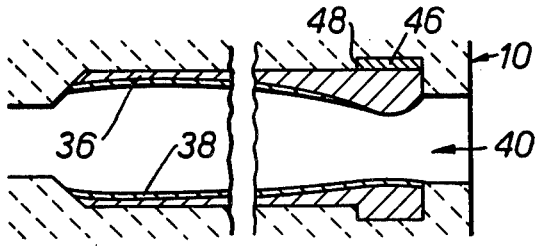
Figure 4E:
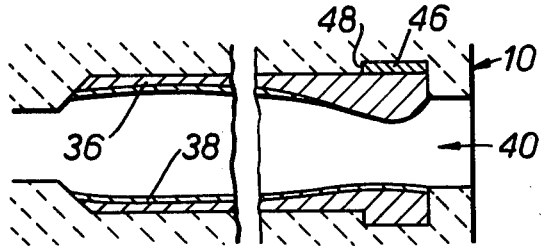

This invention relates to an iron or steelmaking process of the type described in British Patent 1270669 wherein a generally horizontally disposed rotary furnace is charged at its inlet end with iron or steelmaking materials and at that end of the furnace remote from its inlet end liquid metal and slag are discharged therefrom.

In British Patent 1270669 it is envisaged that liquid metal may be discharged continuously from the furnace during operation of the process, but it has been found in practice that during continuous discharge it is difficult to prevent discharge of the slog contents of the furnace in preference to discharge of the liquid metal, leaving an insufficient thickness of slag inside the furnace.

It is an object of the present invention to provide an improved process for iron or steelmaking in a rotary furnace wherein the liquid metal initially is discharged preferentially to the slag followed by an appropriate amount of slag.

In accordance with the invention there is provided in an iron or steelmaking process wherein a refractory lined generally horizontally disposed rotary furnace having an open discharge end and an inlet end for iron or steelmaking materials is rotated about its axis at such a speed that the liquid and solid furnace contents are maintained around the interior by centrigigual force, the said contents comprising liquid metal forming an outer layer in contact with the refractory lining and an inner slag layer spread on the liquid metal; the improvement comprising the steps or reducing the speed of rotation of the furnace during the process to reduce the centrifigual force acting on the furnace contents and permit at least the liquid metal layer adjacent the discharge end of the furnace to increase in thickness whilst at least partially retaining the slag layer within the furnace, discharging a greater proportion of the liquid metal layer than of the slag layer from the discharge end of the furnace and thereafter increasing the speed of rotation of the furnace to retain both the liquid metal and slag layers within the furnace.

Thus by intermittently reducing the rotational speed of the furnace during the process and thereafter restoring the speed to its original level intermittent discharge of a pre-determined amount of liquid metal and slag in the appropriate ratio may be obtained from the furnace.

The term "generally horizontally disposed" as used herein and throughout this specification will be understood to refer to the fact the longitudinal axis of the furnace is inclined at a small angle to the horizontal of the order of between 3° and 5° during normal, i.e. non-discharge, operation of the furnace.

Various means may be employed to retain the slag within the furnace whilst permitting preferential discharge of liquid metal during the periods of speed reduction. It will be appreciated that the discharge end of the furnace includes an annular end dam which under normal operating conditions retains both the liquid metal and slag layers within the furnace. In accordance with a further aspect of the invention a second annular dam may be provided upstream of the end dam, said second dam having interior and exterior diameters less than the respective interior and exterior diameters of the end dam defining an annular passageway for liquid metal between the exterior edge of the second dam and the interior of the furnace. With this arrangement a reduction in the speed of rotation of the furnace will cause the liquid metal layer to increase in tickness until its discharge commences over the interior edge of the end dam whilst the slag layer is retained within the furnace by the second dam.

In accordance with a further aspect of the invention a plurality of fluid jets are directed inwardly of the furnace from the discharge end to impinge on the slag layer upstream of the annular end dam. During a period of speed reduction the liquid metal layer will increase in thickness and be discharged over the interior edge of the end dam but the slag layer will be constrained against discharge by the action of the fluid jets impinging thereon. The intensity of the fluid jets can then be reduced to allow the discharge of an appropriate amount of slag.

In accordance with a yet further aspect of the invention the internal diameter of the furnace adjacent the discharge end thereof may be greater than the internal diameter of the majority of the furnace barrel defining an annular end well at the discharge end. This increase in diameter enhances the instability of the liquid metal layer at this position. In the well there may be further incorporated an axially extending member whereby, on a speed reduction of the furnace, the member will accentuate the preferential casting of liquid metal relative to the slag and hence the liquid constituents of slag and metal can be constrained to discharge in the appropriate ratio.

In accordance with a still further aspect of the invention the furnace may be tilted during a period of speed reduction to accentuate the increase in thickness of the liquid metal layer and assist in promotion of its discharge over the end dam.

Other features of the invention will become apparent from the following description given herein solely by way of example and with reference to the accompanying drawings wherein:

FIG. 1 is a side elevational view partly in section of a typical generally horizontally disposed rotary furnace for use in iron or steelmaking;

FIGS. 2*a* to 2*e* are diagrammatic side section views of the furnace illustrating a first embodiment for retaining the slag at a pre-determined thickness within the furnace and illustrating the relative movement of the furnace contents during speed reduction;

FIGS. 3*a* to 3*e* are diagrammatic side sectional views of the furnace showing a second embodiment for retaining slag at a pre-determined thickness within the furnace and also illustrating the relative movement of the furnace contents during speed reduction;

FIGS. 4*a* to 4*e* are diagrammatic side sectional views of the furnace showing a third embodiment for retaining slag at a pre-determined thickness within the furnace and also illustrating the relative movements of the furnace contents during speed reduction.

A rotary furnace consisting of a drum 10 of generally cylindrical form is mounted for rotation about its axis. The axis is generally horizontally disposed, being inclined at only 3°. Two annular rails 12 surround the drum 10 adjacent to each end of the drum and are engaged by rollers 14 which thus support the furnace. One of the rollers 14 is driven by a motor 16 via a belt 18.

The drum 10 is lined with a layer of refractory material 20. The furnace is open at each end, and the upper or inlet end has projecting into it a pipe 22 for feeding ore, a pipe 24 for feeding coal and limestone, and a fuel oil oxygen burner 26. A refractory lined hood 28 surrounds the inlet end of the furnace. The outlet or discharge end 40 of the furnace is surrounded by a refractory lined hood 30, the bottom of which is provided with a tapping hole 32. The hood has an outlet 34 for waste gases. The refractory lining 20 in the furnace is thicker at each end than in the middle so as to constrict the diameter of the entry and exit of the furnace.

In use the furnace 10 is rotated by means of the motor 16. Ore in particulate form is fed through the pipe 22, coal and limestone are fed through the pipe 24, and fuel and oxygen introduced through the burner 26. Carbon reduces the ore to iron and carbon monoxide, and oxygen oxidizes the resultant carbon monoxide to carbon dioxide, thus releasing heat required to maintain the process. The furnace is rotated at a sufficient speed to spread the contents of the furnace in a layer around the inner surface. Under the centrifugal force the various liquid and solid constituents segregate into separate layers, and the heaviest constituent, iron, is maintained as the outer layer 36 against the refractory surface. The layers of iron 36 and a slag layer 38 are shown in FIG. 1.

In order to retain the liquid furnace contents on the interior wall of the furnace 10 it is normally necessary to operate the process so that there is a centrifugal acceleration of 3.5g to 18g, preferably 6g to 12g, at the inside surface of the furnace.

In accordance with the broad aspect of the invention the speed of rotation of the furnace 10 is reduced during operation of the process to reduce the centrifugal force acting on the furnace contents and permit at least the liquid metal layer 36 adjacent the discharge end 40 to increase in thickness whilst retaining the slag layer 38 within the furnace behind an annular end dam 42 at the discharge end 40. Part of the liquid metal layer 36 will discharge, during the speed reduction period, over the end dam 42 followed by discharge of an appropriate amount of the slag 38. The speed of rotation of the furnace is then increased to retain both the liquid metal layer 36 and the slag layer 38 within the furnace.

Various means may be employed in order to facilitate and/or accentuate the preferential casting of liquid metal in an appropriate ratio to the slag.

Referring to FIGS. *2a* to *2e* of the drawings there is shown at the discharge end 40 of the furnace 10 a second annular dam 44 located upstream of the other annular end dam 42. The end dam 42 functions to retain both liquid metal 36 and slag 38 within the furnace during the normal operation speed of rotation. The second annular dam 44 has interior and exterior diameters which are less than the respective interior and exterior diameters of the end dam 42 thereby defining an annular passageway for liquid metal between the radially outer edge of the second dam and the refractory lining 20 of the furnace. This passageway thereby provides a flow for liquid metal from the main body of the furnace into the space between the two dams.

When the furnace is operating at its normal speed of rotation both the liquid metal and slag layers are maintained within the furnace at a level below the interior edge of the end dam 42 as is shown in FIG. *2a*. As the speed of rotation of the furnace is reduced instability of the layers is promoted at the discharge end 40 of the furnace and the liquid metal layer 36 gradually increases in thickness whereby the effective diameter of the slag layer 38 spread thereon is reduced. By controlling the reduction in speed of rotation of the furnace movement of the layers may be induced as illustrated in FIGS. *2b* to *2e* until the liquid metal layer contained within the space between the two dams 42-44 commences discharge over the interior edge of the end dam 42 whilst the slay layer is retained by the second dam 44, until its depth increases and it is discharged in an appropriate ratio to the liquid metal.

In FIG. *3a* of the drawings a stable situation is again illustrated whilst FIGS. *3b* to *3e* illustrate the relative movement of the liquid and slag layers 36-38 during the reduction in speed of the furnace 10. However, in this embodiment and as illustrated by the arrows in FIGS. *3b* to *3e* a plurality of gas jets are directed inwardly of the discharge end 40 of the furnace to impinge on the slag layer 38 upstream of the end dam 42. Thus the slag layer 38 is retained within the furnace whilst part of the liquid metal 36 discharges over the interior edge of the end dam 42 as speed is reduced. With this arrangement the gas jets could be utilised to freeze an inner ring of the slag layer surface (perhaps to a depth of 0.5 cm to 5 cm) which in turn could form a secondary dam arrangement to function in a similar manner to that described iwith reference to FIGS. *2a* to *2e*.

In FIG. *4a* of the drawings a stable situation is again illustrated while FIGS. *4b* to *4e* illustrate the relative movement of the liquid and slag layers 36-38 during the reduction in speed of the furnace 10. In this embodiment an axially extending member in the form of a bar 46 of appropriate cross-sectional configuration is located within an annular end well 48 for enhancing the preferential casting of liquid metal relative to the slag. It has been found that correct positioning of the bar 46, in particular its angle relative to the circumference and axis of the furnace, can ensure that the liquid metal and slag are discharged in the appropriate ratio.

Although not illustrated herein the annular end well 48 may be stepped providing two adjacent wells of differing diameters, the larger diameter well being downstream of the smaller diameter well. An axially extending member in the form of a bar of appropriate cross-sectional configuration is located within the two wells again to enhance the preferential casting of liquid metal relative to the slag.

The furnace 10 is normally operated in a generally horizontal mode that is to say its longitudinal axis is inclined to the horizontal at between 3° and 5°. In a further embodiment of the invention the furnace is further inclined to the horizontal, such as by an additional slope of up to 3° during a period of speed reduction, in order to accentuate the instability of the metallic layer 36 at the discharge end 40 of the furnace and promote discharge of the liquid metal 36 whilst the majority of the slag layer 38 is retained within the furnace by any of the means hereinbefore described.

It will be appreciated therefore that the method described in accordance with the invention permits a continuous operation of an iron or steelmaking process within the furnace whilst effectively providing a batch discharge of liquid metal therefrom together with an appropriate amount only of depleted iron-bearing slag.

We claim:

1. In an iron or steelmaking process wherein a refractory lined generally horizontally disposed rotary furnace having an open discharge end and an inlet end for iron or steelmaking materials is rotated about its axis at such a speed that the liquid and solid furnace contents are maintained around the interior by centrifugal force, the said contents comprising liquid metal forming an outer layer in contact with the refractory lining and an inner slag layer spread on the liquid metal; the improvement comprising the steps of reducing the speed of rotation of the furnace during the process to reduce the centrifugal force acting on the furnace contents to promote instability of the slag and liquid metal layers adjacent the discharge end of the furnace and permit at least the liquid metal layer adjacent the discharge end of the furnace to increase in thickness whilst at least partially retaining the slag layer within the furnace, discharging a greater proportion of the liquid metal layer than of the slag layer from the discharge end of the furnace during the period of instability in which the liquid metal has increased in thickness at said discharge end of the furnace and thereafter increasing the speed of rotation of the furnace to retain both the liquid metal and slag layers within the furnace.

2. A process according to claim 1 including the step of tilting the furnace during a period of speed reduction to accentuate the increase in thickness of the liquid metal layer at the discharge end of the furnace.

3. Apparatus for carrying out the process of claim 1 comprising a refractory lined generally horizontally disposed rotary furnace having an open discharge end and an inlet end for iron or steelmaking materials, the furnace being rotatable about its axis at such a speed that the liquid and solid furnace contents are maintained around the interior by centrifugal force, the said contents comprising liquid metal forming an outer layer in contact with the refractory lining and an inner slag layer spread on the liquid metal; the improvement comprising means for retaining the slag within the the furnace whilst permitting preferential discharge of liquid metal from the discharge end of the furnace during a period of speed reduction of the furnace.

4. Apparatus as claimed in claim 3 wherein said means comprises a first annular end dam at the discharge end of the furnace and a second annular dam upstream of said first dam; said second dam having interior and exterior diameters less than the respective interior and exterior diameters of the first dam to define an annular passageway for liquid metal between the exterior edge of the second dam and the interior of the furnace.

5. Apparatus as claimed in claim 3 wherein said means comprises an annular end dam at the discharge end of the furnace and a plurality of fluid delivery means for delivering fluid to impinge on the slag layer upstream of said end dam.

6. Apparatus as claimed in claim 3 wherein said means comprises an annular end well at the discharge end of the furnace, said well being defined by the furnace having an internal diameter adjacent the discharge end which is greater then the internal diameter of the majority of the remainder of the furnace.

7. Apparatus as claimed in claim 6 wherein said means additionally includes an axially extending member located in the annular end well for accentuating the preferential casting of liquid metal relative to the slag.

* * * * *